US008308134B2

(12) United States Patent
Stanimirovic et al.

(10) Patent No.: US 8,308,134 B2
(45) Date of Patent: Nov. 13, 2012

(54) MOBILE JACK WITH LOCKING ASSEMBLY

(75) Inventors: Branimir Stanimirovic, Toronto (CA); Alec Stanimirovic, Toronto (CA)

(73) Assignee: Stan Design, Inc., Mississauga, Ontario (CA)

( * ) Notice: Subject to any disclaimer, the term of this patent is extended or adjusted under 35 U.S.C. 154(b) by 353 days.

(21) Appl. No.: 12/763,636

(22) Filed: Apr. 20, 2010

(65) Prior Publication Data

US 2011/0253959 A1 Oct. 20, 2011

(51) Int. Cl.
*B66F 3/00* (2006.01)
*B66F 3/24* (2006.01)

(52) U.S. Cl. ..... 254/1; 254/122; 254/124; 254/126

(58) Field of Classification Search ..... 254/1, 2 B, 254/2 R, 7 C, 10 B, 93 L, 122, 123, 124, 254/126, 129
See application file for complete search history.

(56) References Cited

U.S. PATENT DOCUMENTS

| | | | | | |
|---|---|---|---|---|---|
| 2,829,863 | A | * | 4/1958 | Gibson | 254/8 C |
| 3,237,921 | A | * | 3/1966 | Jay | 254/122 |
| 3,628,771 | A | * | 12/1971 | Egeland et al. | 254/122 |
| 4,692,084 | A | * | 9/1987 | Persson | 414/607 |
| 4,724,930 | A | | 2/1988 | VanLierop | |
| RE32,715 | E | | 7/1988 | Arzouman | |
| 5,096,160 | A | | 3/1992 | Calico et al. | |
| 5,222,717 | A | * | 6/1993 | Traficant | 254/122 |
| 5,322,143 | A | * | 6/1994 | Curran | 187/211 |
| 5,394,959 | A | * | 3/1995 | Cullity et al. | 187/244 |
| 5,855,359 | A | | 1/1999 | Chipperfield | |
| 5,967,494 | A | | 10/1999 | Fiorese | |
| 6,464,205 | B2 | | 10/2002 | Wanner | |
| 6,619,620 | B1 | * | 9/2003 | Carter | 254/10 C |
| 6,705,238 | B1 | | 3/2004 | Heckert | |
| 6,814,188 | B1 | | 11/2004 | Heckert | |
| 6,974,123 | B2 | * | 12/2005 | Latvys | 254/122 |
| 2004/0200258 | A1 | | 10/2004 | Hess | |
| 2008/0173852 | A1 | | 7/2008 | Woodbury et al. | |

OTHER PUBLICATIONS

Floor/Service Jacks, http://www.uniquetruck.com/Floor_Service_Jacks_C35.cfm, retrieved Sep. 18, 2009, copyright 2007, 2 pgs.
Air/Hydraulic Service Jacks, http://www.uniquetruck.com/Floor_Service_Jacks_C37.cfm, retrieved Sep. 18, 2009, copyright 2007, 2 pgs.
Bottle Jacks & Jack Stands, http://www.uniquetruck.com/Floor_Service_Jacks_C38.cfm, retrieved Sep. 18, 2009, copyright 2007, 2 pgs.

(Continued)

*Primary Examiner* — Lee D Wilson
*Assistant Examiner* — Joseph J Sadlon
(74) *Attorney, Agent, or Firm* — Brooks Kushman P. C.

(57) ABSTRACT

A mobile jack is provided for a vehicle the where the mobile jack includes a movable base with a plurality of rollers adapted for moving the jack upon a generally horizontal support surface and positioning the jack under a load. The mobile jack may lift loads using a scissor assembly lying in a vertical plane where the scissor assembly connected between the movable base and an upper platform. Additionally, the mobile jack may include at least one hydraulic cylinder for actuating the scissor assembly. The mobile jack may include a safety lock for locking the upper platform in a lifted position where the lock is movable between at least one locked and unlocked position. When the upper platform is in the lifted position, the lock automatically moves to the locked position so that it cooperates with the scissor assembly to prevent the scissor assembly from lowering independent of the cylinders.

20 Claims, 7 Drawing Sheets

OTHER PUBLICATIONS

Service Jacks Products, http://www.shinnfuamerica.com/Products/Product__Categories.aspx?Id=99, retrieved Sep. 18, 2009, copyright 2009, 1 pg.

Air Actuated Chassis Service Jacks Products, http://www.shinnfuamerica.com/Products/Product__Categories.aspx? Id=738, retrieved Sep. 18, 2009, copyright 2009, 1 pg.

Truck Jack Products, http://www.shinnfuamerica.com/Products/Product__Categories.aspx?Id=9, retrieved Sep. 18, 2009, copyright 2009, 1 pg.

Floor Jacks, http://www.norcoind.com/norco/category__type__FloorJacks.shtml, retrieved Sep. 18, 2009, copyright 2009, 2 pgs.

Air Lift Jacks, http://www.norcoind.com/norco/category__type__AirLiftJacks.shtml, retrieved Sep. 18, 2009, copyright 2009, 1 pg.

J12000H, http://www.standesigninc.com/j12.htm, retrieved Sep. 22, 2009, copyright 2003, 1 pg.

J6000H, http://www.standesigninc.com/j6000h.htm, retrieved Sep. 22, 2009, copyright 2003, 1 pg.

* cited by examiner

MOBILE JACK WITH LOCKING ASSEMBLY

TECHNICAL FIELD

The present invention relates to a mobile jack assembly for lifting vehicles.

BACKGROUND

While hydraulic jacks may be common, many mobile jacks available today are either a single hydraulic cylinder where the hydraulic cylinder must be manually activated or the jack must be activated with an air assist mechanism. Further, most conventional service jack designs use a pantograph style mechanical device to lift the load. Current single cylinder jacks or pantograph designs are not capable of the lifting power needed in some applications. Further the traditional mobile jack designs are difficult to position or are unsafe because they only provide one lifting contact point.

However, the mobile service jack with more lifting power, such as with multiple cylinders, or a jack designed to have more than one lifting point, must still be compact and maneuverable to allow it to easily fit and be placed under a vehicle.

In addition, hydraulic jacks are subject to inadvertent release or failure. With conventional mobile jacks, the operator must place a vehicle lift or jack stand under the vehicle to ensure the safety of the operator in the event of a cylinder failure, once the vehicle is in the lifted position.

SUMMARY

An embodiment of the present invention includes a mobile jack for a vehicle. The mobile jack includes a movable base which has a plurality of rollers adapted for moving and positioning the jack upon a generally horizontal support surface. Further, the mobile jack may include an upper platform adapted for lifting loads, the upper platform movable between at least one lowered position and at least one lifted position. To move the upper platform between the lifted and lowered positions, the mobile jack includes a pair of scissor lifting assemblies each lying in a vertical plane located adjacent to and spaced apart from one another, each of the scissor assemblies having a first scissor leg having an upper and lower ends, the lower ends of the first legs pivotally fixed to the movable base and the upper ends of the first legs translating along the upper platform, and each of the scissor assemblies having a second scissor leg pivotally fixed to the first scissor leg at a horizontal scissor axis, the second legs having an upper and lower ends, the lower ends of the second scissor legs translating along the movable base, the upper end pivotally mounted to the upper platform. A pair of hydraulic cylinders are adapted for lifting the upper platform between the lowered and lifted positions, a first one of the hydraulic actuators operatively connected between the upper end of the first scissor legs and the lower end of the second scissor legs, the other of the hydraulic cylinders operatively connected between the upper end of the second scissor legs and the lower end of the first scissor legs. The mobile jack further includes a lock assembly adapted for locking the upper platform in at least one lifted position independent of the actuation of the hydraulic cylinders, the lock assembly having a locking arm pivotally mounted on the movable base at a first end and the locking arm having a locking element at a second end. When the upper platform is in at least one of the lifted positions, the lower ends of the second scissor legs slide inboard with respect to the first scissor legs, and the locking arm pivots so that the locking element is lowered and supported by the base outboard of the lower ends of the second scissor legs, thereby preventing the second scissor legs from sliding back to the lowered.

An further embodiment of the present invention is a mobile jack for a vehicle the where the mobile jack includes a movable base with a plurality of rollers adapted for moving the jack upon a generally horizontal support surface and positioning the jack under a load. The mobile jack may further include an upper platform adapted for lifting loads and a scissor assembly lying in a vertical plane where the scissor assembly is connected between the movable base and the upper platform. Additionally, the mobile jack may include at least one hydraulic cylinder for actuating the scissor assembly. The mobile jack may further include a safety lock adapted for locking the upper platform in at least one lifted position where the lock is movable between at least one locked and unlocked position. When the upper platform is in the lifted position, the lock automatically moves to the locked position so that it cooperates with the scissor assembly to prevent the scissor assembly from lowering independent of the actuators.

An additional embodiment of the present invention is a mobile jack for a vehicle the where the mobile jack a movable base including a plurality of rollers adapted for moving and positioning the jack upon a generally horizontal support surface and an upper platform adapted for lifting loads. The jack may include at least one scissor assembly for moving the upper platform in a vertical direction where the scissor assembly has a first scissor leg with an upper and lower end, the lower end pivotally fixed to the movable base, the upper end translating along the upper platform, and the scissor assembly has a second scissor leg pivotally coupled to the first scissor leg at a scissor pivot point, the second leg having an upper and lower end where the lower end translates along the movable base and the upper end is pivotally fixed to the upper platform. The mobile jack may include at least two cylinders operatively connected to the scissor lifting assembly and adapted for actuating the first and second scissor legs thereby moving the upper platform between a lowered and lifted position. One of the actuators is operatively connected to the first scissor leg and the other of the hydraulic actuator is operatively connected to the second scissor leg. Further, the mobile jack may include a lock adapted for locking the scissor lifting assemblies in the lifted position where the lock is movable between at least one locked and unlocked position. When the upper platform is in the lifted position, the lock is in the unlocked position and engages at least one of the scissor legs and the base or the other scissor leg to limit movement in order to prevent the scissor assembly from lowering independent of the cylinders.

BRIEF DESCRIPTION OF THE DRAWINGS

The present invention is pointed out with particularity in the appended claims. However, other features of the present invention will become more apparent and the present invention will be best understood by referring to the following detailed description in which:

DETAILED DESCRIPTION

As required, detailed embodiments and embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention. The features of various implementing embodiments may be combined to form further embodiments of the invention.

Figure 1:
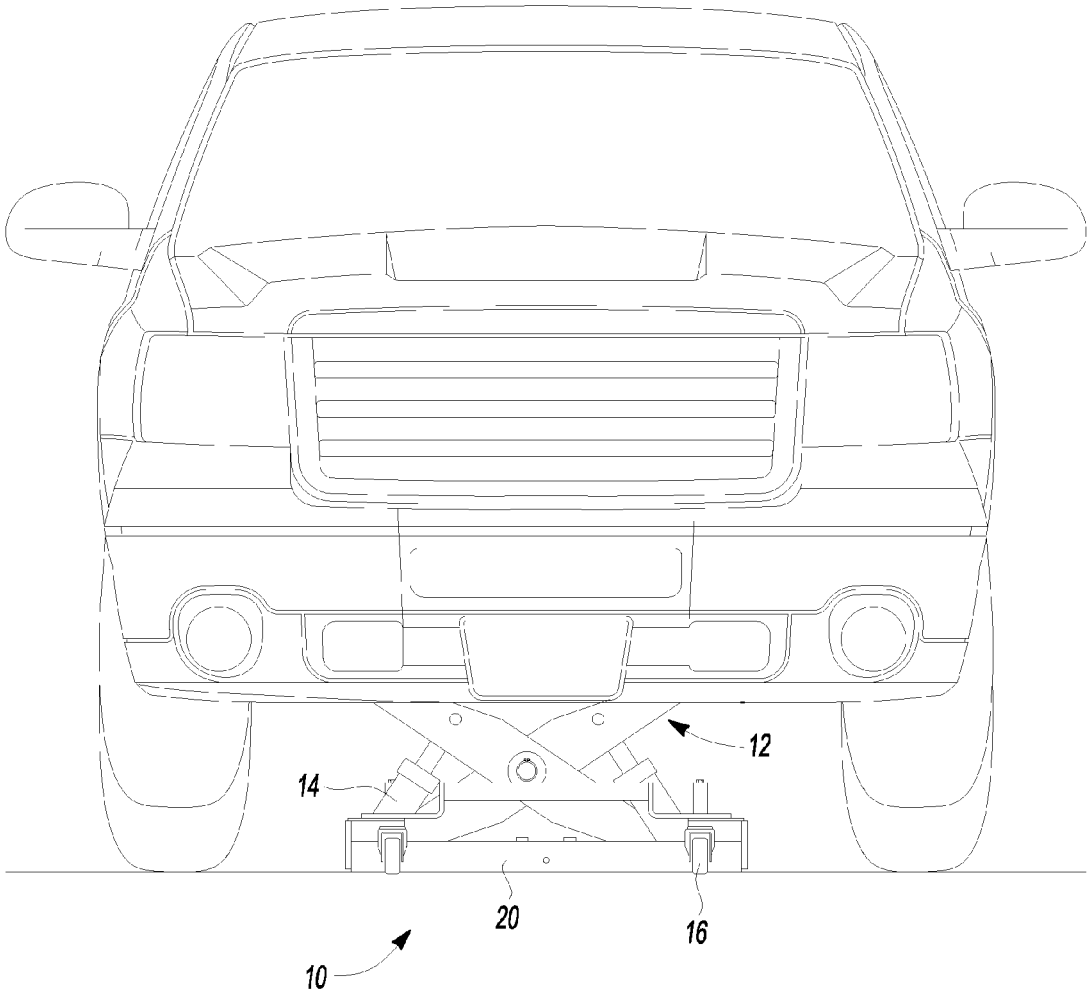
FIG. 1 illustrates a perspective view of a mobile jack according to an embodiment of the present invention.

FIG. 1 illustrates a perspective view of a mobile jack 10 according to an embodiment of the present invention. As shown, the mobile jack 10 may be positioned under a vehicle, including, but not limited to an automobile, truck, bus or a trailer. The scissor assemblies may allow the mobile jack 10 to the lowered into a compact assembly, which can be easily maneuvered under a vehicle. In a lowered position, the mobile jack 10 may have a low profile of eight inches or less to allow it to go under low vehicles or obstacles. The scissor assemblies 12 may allow the mobile jack 10 to lift in excess of eleven inches from the lowered compact position to a raised and lifted position.

In order be maneuvered on a generally horizontal surface, the mobile jack 10 may also have caster assemblies 16, wheels or other type of roller to allow the mobile jack 10 to be easily directed into position. The mobile jack 10 may further include a handle 18 which allow for mobility and positioning the mobile jack 10 under a vehicle. As illustrated in FIG. 1, the mobile jack 10 may roll under the front end or rear end of a truck or bus in order to position the mobile jack 10 under the axle, for example.

The scissor lifting assembly 12 allows the mobile jack 10 to have more than one point of contact with the vehicle. For example, the mobile jack 10 may be aligned so that it contacts the vehicle along the axle. By aligning the mobile jack 10 with a feature on the vehicle, such as the axle, the mobile jack 10 may pick up the vehicle, via two or more contact points 24. In the event that the mobile jack 10 slips or the load shifts, having more than one contact point 24 may enable additional stability and a further safety feature.

Figures 2A, 2B:
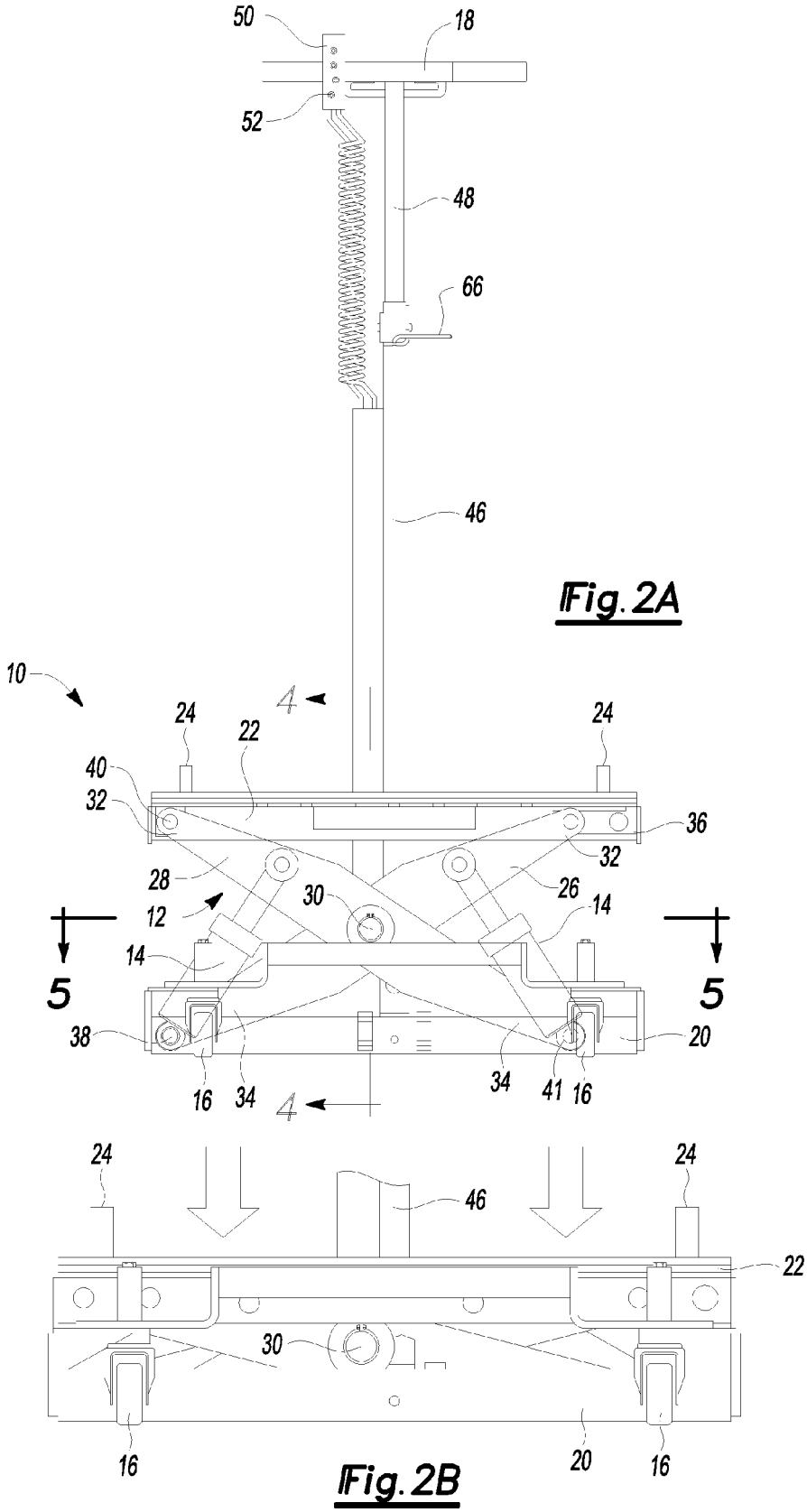
FIG. 2A illustrates a perspective view of a mobile jack according to an embodiment of the present invention.
FIG. 2B illustrates a perspective view of a mobile jack according to an embodiment of the present invention in a lowered position.

As further illustrated in FIG. 2, the mobile jack 10 may be moved and positioned under a vehicle or a load with caster assemblies 16 which are connected to a mobile base 20. The caster assemblies 16 may be spring loaded such that when the mobile jack 10 contacts a load, such as a vehicle, the springs would compress and the load would be transferred to the base 20 of the mobile jack 10 so that the mobile base 20 would be in contact with the floor in order to prevent unwanted movement while the mobile jack 10 is in use.

FIG. 2 illustrates a front plan view of the mobile jack 10 according to an exemplary embodiment of the invention. FIG. 2 illustrates the mobile jack 10, which may perform lifting through a scissor lifting assembly 12 with hydraulic cylinders 14. The pair of hydraulic cylinders 14 may work in tandem to expand the scissor assembly 12, thereby lifting loads such as a vehicle. By having two hydraulic cylinders 14, it is contemplated that the mobile jack may lift 24,000 pounds or more. It is also contemplated that the mobile jack may use one hydraulic cylinder 14 to expand the scissor assembly 12. In such a case, the hydraulic cylinder 14 may be larger sized having a larger bore in order to lift the loads.

The mobile jack 10 may include an upper platform 22 adapted for lifting loads such as a vehicle. The upper platform 22 may be connected to the movable base 20 with a scissor lifting assembly 12. The upper platform 22 may be generally horizontal to the floor, even as it is lifted and lowered. The upper platform 22 may further include at least one contact point 24 which may be configured to support or contact any loads.

The contact points 24 may be positioned at different locations along the upper platform 22 in order to accommodate different spacing depending on the objected being lifted. Additionally, the contact points 24 may be different heights or have geometric different configurations in order to accommodate different lifting or load situations. In addition, the upper platform 22 may include at least two contact points 24 where the contact points 24 are oriented along the longitudinal axis of the upper platform 22. The location of the contact points 24 along the upper platform 22 may further be adjustable.

The upper platform 22 may be connected to the mobile base 20 with the scissor lifting assembly 12. The scissor lifting assembly 12 may lie in a vertical plane between the mobile base 20 and upper platform 22 and the scissor assembly 12 may have a first scissor leg 26 and a second scissor leg 28. The first 26 and second scissor legs 28 may be pivotally connected to each other at a generally horizontal scissor axis 30 at a center portion of the scissor legs 26, 28. Each of the scissor legs 26, 28 may have a lower end 34 which is connected to the movable base and an upper end 32 which is connected to the upper platform 22.

In an exemplary embodiment of the present invention, a lower end 34 of the first scissor leg 26 may be pivotally mounted or fixed to the movable base 20 and the upper end 32 of the first scissor leg 26 may be able to translate along the upper platform 22 as the scissor assembly 12 is raised into an upper position. The upper platform 22 may include a guide track 36 to facilitate the translation of the upper end 32 of the first scissor leg 26. The upper end 32 of the first scissor leg 26 may include a pin or post 35 that is configured to translate in the guide track 36.

The guide track 36 may be formed in a vertical side wall of the upper platform 22. However the upper platform 22 may also be adapted to have a rail, oblong opening or other guide device to allow translation of the upper end 32 of the first scissor leg 26. The guide track and pin 35 also may allow rotation of the upper end 32 of the first scissor leg 26 as the lifting assembly is actuated. The lower end 34 of the first scissor leg 26 may be allowed to rotate, but may not translate along the base 20. The lower end 34 of the first scissor leg 26 may be pivotally mounted or fixed to the base 20 at a fixed point with a hinge-type connection or any other suitable connection that allows the lower end 34 of the first scissor leg 26 to rotate but remain in a fixed position as the scissor assemblies 12 are raised.

Conversely, in an embodiment of the present invention, the second scissor leg 28 may have a lower end 34 which may translate along the movable base 20 and an upper end 32 which may be pivotally mounted or fixed to the upper platform 22 at a upper fixed point 40. Likewise, the upper end 32 of the second scissor leg 28 may be pivotally fixed to the upper platform 22 with a hinged-type feature to allow the upper end 32 of the second scissor leg 28 to rotate but remain in a fixed position as the scissor assemblies 12 are actuated.

The lower end 34 of the second scissor leg 28 may slide along the movable base 20 with a roller 41 or may roll in a track or slide in a groove or flange 42 formed on the base 20. The outboard movement of the lower end 34 of the second leg may be limited by a stop wall 44 on the movable base 20 such that when the scissor assembly 12 is lowered, the roller may contact the stop wall 44 to prevent further lowering of the scissor assembly 12. When the scissor assembly 12 is actuated, the lower end 34 of the second scissor leg 28 may translate or roll inboard from the stop wall 44. It is further contemplated that both the upper ends 32 and lower ends 34 of the scissor legs 26, 28 may slide or translate as the scissor lifting assembly 12 is actuated. In this case, there may be a stop wall 44 or other limiting device located on opposing ends of the mobile base 20.

The mobile jack 10 may also include a pair of hydraulic cylinders 14 adapted for lifting the upper platform 22 between lowered and lifted positions. The hydraulic cylinders 14 may work in tandem to expand the scissor assemblies 12 in a vertical direction and lift the upper platform 22 and a load in contact with the upper platform 22. The first hydraulic cylinder 14 may be connected to the first scissor leg 26 and a lower end 34 of the second scissor leg 28. The other hydraulic cylinder 14 may be connected between the second scissor leg 28 and a lower end 34 of the first scissor leg 26. By operatively connecting the first hydraulic cylinder 14 to the lower end 34 of the second scissor leg 28 the first hydraulic cylinder 14, the hydraulic cylinder 14 may slide or translate along the movable base 20 in cooperation with the lower end 34 of the second scissor assembly 12 as the scissor assemblies 12 are actuated.

Figure 3:
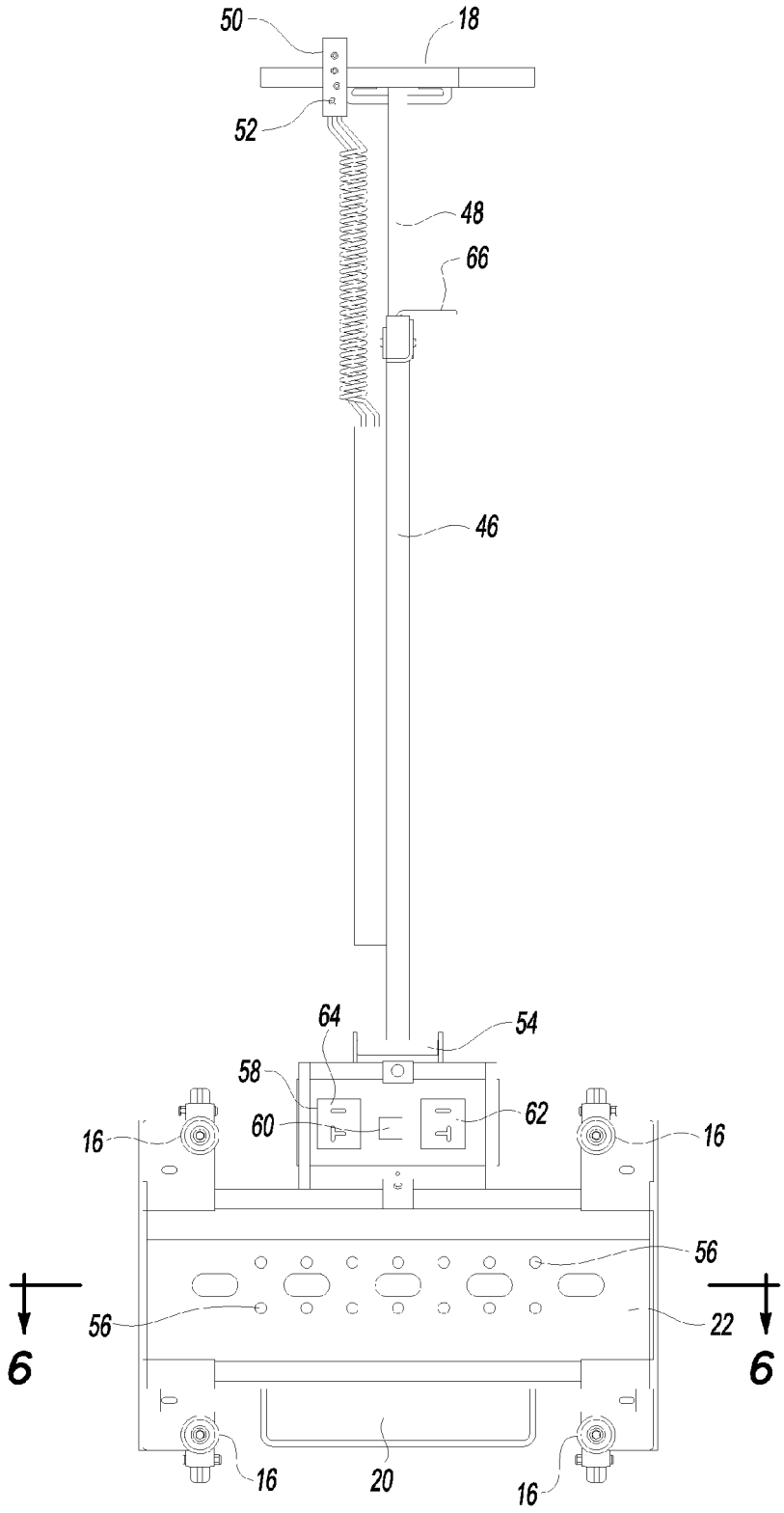
FIG. 3 illustrates a top view of a mobile jack according to an embodiment of the present invention.

FIG. 3 illustrates a top plan view of a mobile jack 10 according to an exemplary embodiment of the present invention. The mobile jack 10 has a handle 18 which is shown in the horizontal position while it is in use. The handle 18 may have a main portion 46 and may also include an extension portion 48 which may telescope from the main portion 46 when a longer handle 18 is required. The handle 18 may include a control panel 50 which may have buttons or control mechanisms 52 for remotely activating the hydraulic cylinders 14 as well as the lock assembly 70 (discussed below).

The handle 18 may be operatively connected to the base 20 with, for example, a hinge 54. The handle hinge 54 may be spring loaded to allow the handle 18 to be locked in a vertical position when not in use. The handle 18 may also be disconnected from the base 20 once the mobile jack 10 is positioned under a vehicle so that the handle 18 is not in the way of an operator.

As shown in the top view, the upper platform 22 may include a plurality of apertures 56 which may be used for attaching the contact points 24 at different positions. The movable base 20 further includes caster assemblies 16 for moving the mobile jack 10 and positioning under a load.

Figure 4:
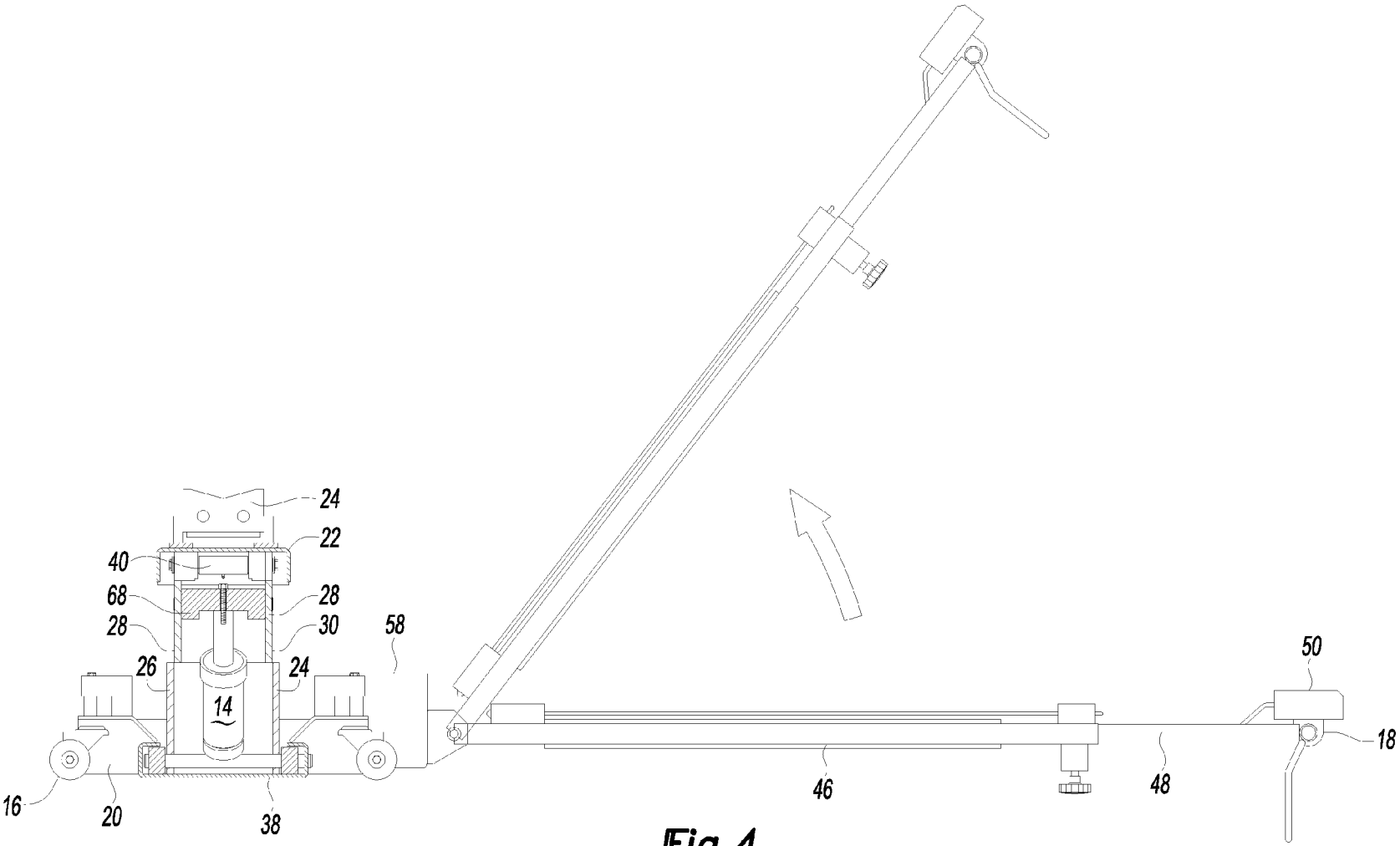
FIG. 4 illustrates a side section view along section 4-4 from FIG. 2 of a mobile jack according to an embodiment of the present invention.

The mobile base 20 may also be adapted to include a power block 58. The power block 58 may include a hydraulic pump 62 which may be used to develop hydraulic pressure to expand and contract the hydraulic cylinders 14 and a pneumatic pump assembly 64 used to activate a release mechanism 72 of a lock assembly 70. The hydraulic pump 62 and pneumatic pump 64 may run on a battery or other suitable power supply 60 such as a compressed air motor which may be housed on the mobile base 20. I FIG. 4 illustrates a side section view of the mobile jack 10 according to an exemplary embodiment of the present invention. The side section view is along section 4-4 from FIG. 2. In the side view, it is illustrated that the handle 18 may be rotated from a horizontal position for when the mobile jack 10 is in use to a vertical position for storage. The handle 18 includes a release lever 66 which unlocks the handle 18 and so that the handle 18 may be rotated by a user. While the mobile jack 10 is in use, the handle 18 may be lowered and rested on the floor, as illustrated in FIG. 3. The handle 18 may be articulated so that it can be raised to a vertical position or storage position, as shown in FIG. 2. Further, the handle 18 may telescope in order extend the length of the handle 18 which may further help in positioning the mobile jack 10 from a distance away from the vehicle.

To lift and lower the mobile jack 10 and operator may control the activation of the mobile jack 10 remotely from the handle 18 with a button 52 on a control panel 50 attached to the handle 18. The mobile jack 10 may be compact and easily maneuverable with the handle 18. The control panel 50 may be detachable from the handle 18. By detaching the control panel 50 from the mobile jack 10 and handle 18, the user may be able to spot the load easier as they are lifting and lowering the mobile jack 10. The control panel 50 may be operatively connected to the hydraulic pump 62, pneumatic motor 64, power supply 60 or any other devices used to control operation of the mobile jack 10.

FIG. 4 further illustrates that the mobile jack may have a second scissor assembly 12. The pair of scissor assemblies 12 may be spaced apart from another and lying generally parallel to each other in a vertical plane. By having a pair of scissor assemblies 12, the mobile jack may have greater stability and increased lifting capabilities. The pair of scissor assemblies 12, while spaced apart from each other, may be operatively connected so that they may raise and lower in tandem.

The pair of scissor lifting assemblies 12 may be further connected along the first lower scissor ends 34 proximate the base 20 by a hinge 38 or other mechanism that allows the first lower scissor ends 34 to rotate while remaining in a fixed position on the base 20. The pair of scissor lifting assemblies 12 may be also connected along the second lower scissor ends 34 by a roller 41 or pin which allows the second lower scissor ends 34 to roll or translate along the base 20. Likewise, the pair of scissor assemblies 12 may be connected along the upper ends 32 adjacent the upper platform 22 with a roller, hinge, connecting rod or similar connection mechanism. Additionally, the pair of scissor assemblies 12 may be operatively connected along the scissor axis 30.

Where there is a pair of scissor assemblies 12, the hydraulic cylinders may be located between the each of the scissor lifting assemblies 12. In this configuration, the hydraulic cylinders 14 may be connected or joined to the scissor assemblies 12 by a connection bar 68 which connects the pair of scissor assemblies 12 along the upper ends 32 of the scissor legs 26, 28. The hydraulic cylinders 14 may also be operatively connected to the scissor legs 26, 28 along the lower ends. Alternatively, the hydraulic cylinders may be mounted on the mobile base.

FIG. 4 illustrates the scissor assemblies 12 and upper platform 22 in a raised position where the hydraulic cylinders 14 may also be in an extended or actuated position. FIG. 4 further illustrates where the spring loaded castor assemblies 16 may be activated so that the base 20 is in contact with the floor as if the mobile jack 10 were supporting a load.

Figure 5:
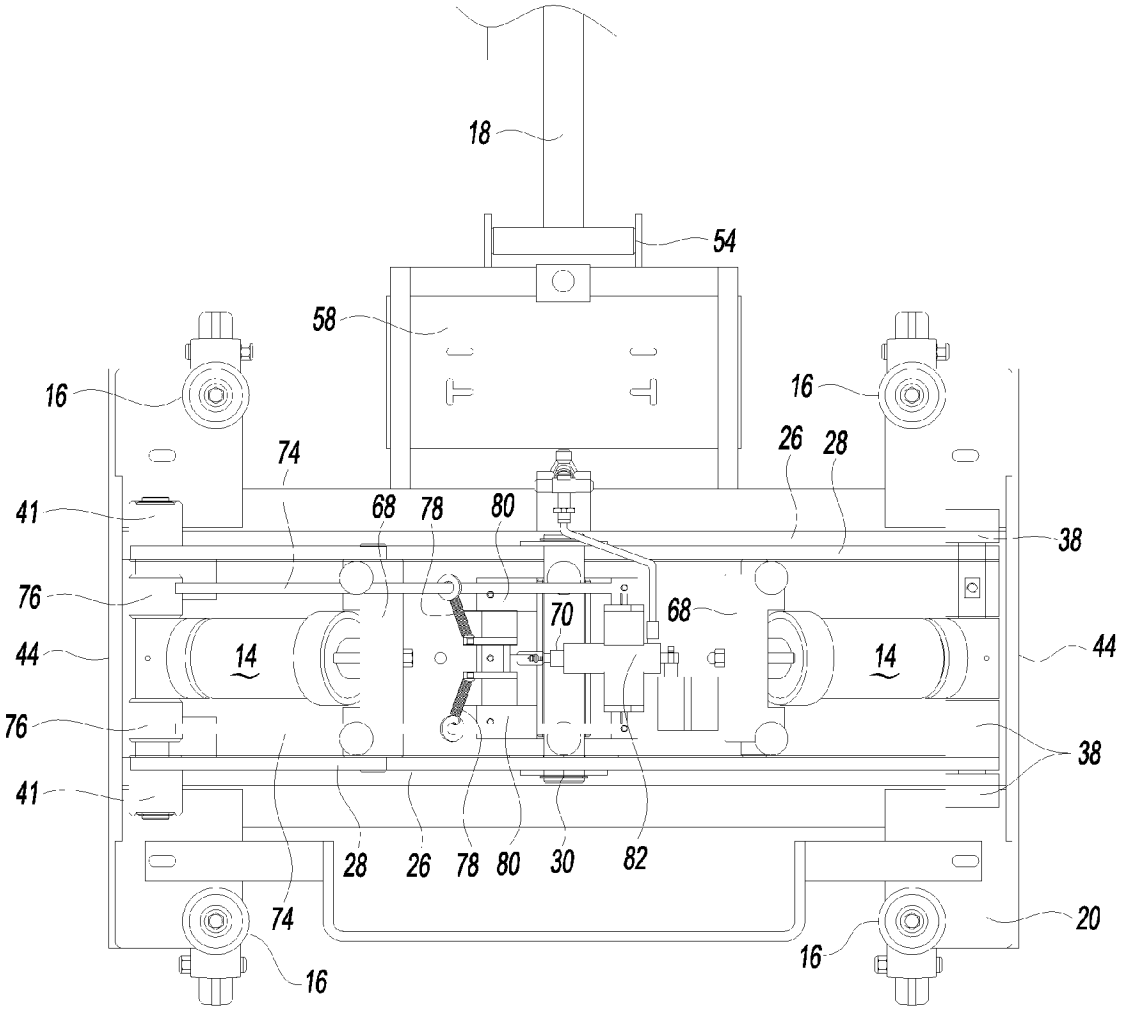
FIG. 5 illustrates a top section view along section 5-5 from FIG. 2 of a mobile jack according to an embodiment of the present invention.

FIG. 5 illustrates a section view of the mobile jack 10 along section 5-5 in FIG. 2. In this top section view, the mobile jack 10 is illustrated in a lowered position. In the lowered position, the scissor assemblies 12 may be generally parallel to the base 20 and the lower ends 34 of the scissor legs 26, 28 may extend to the stop walls 44 of the movable base 20.

The hydraulic cylinders 14 are disposed between the scissor assemblies 12. The first hydraulic cylinder 14 may be connected to the scissor assemblies 12 along one end by the connecting bar 68 and along the other end by a roller 41 which connects the lower ends 34 of the second scissor legs 28. When the hydraulic cylinders 14 are actuated, the first hydraulic cylinder 14 may translate along the mobile base 20 in tandem with the roller 41 which may connect the lower ends 34 of the second scissor legs 28. The second hydraulic cylinder 14 may be mounted on the mobile base 20 and may be fixed at one end so that it rotates but does not translate as the second hydraulic cylinder 14 is actuated. The second hydraulic cylinder 14 may be mounted on along the lower fixed point 38 which connects the lower ends 34 of the second scissor legs 28. At its other end, the second cylinder 14 may also be connected to a connecting bar 68 that connects the pair of scissor assemblies 12.

Additionally, in the lowered position illustrated in FIG. 5, the locking assembly 70 is illustrated in an unlocked position. When the locking assembly 70 is in an unlocked position, the lower end 34 of the scissor legs 26, 28 may not be prevented from extending to the stop walls 44 of mobile base 20. As further described in FIG. 6 and FIG. 7 below, the lock assembly 70 may include a locking arm 74, a locking element 76, springs 78, and a release mechanism 72 including cams 80 and a pneumatic cylinder 82.

Figure 6A:
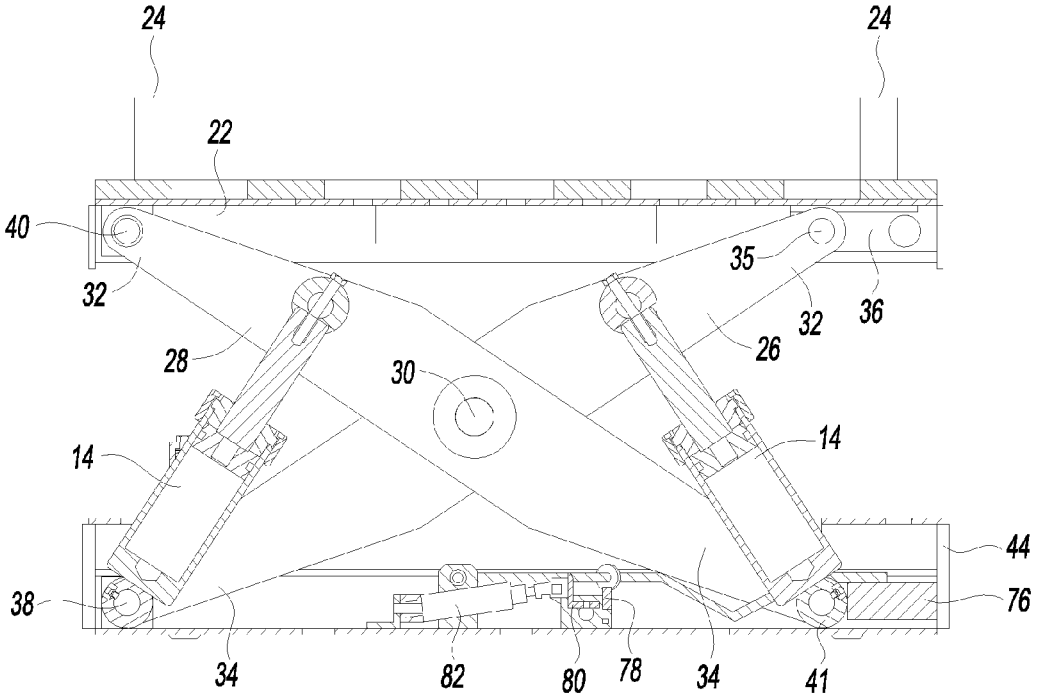
FIG. 6A illustrates a section view along section 6-6 in FIG. 3 showing an embodiment of the mobile jack of the present invention in a locked position.
Figure 6B:
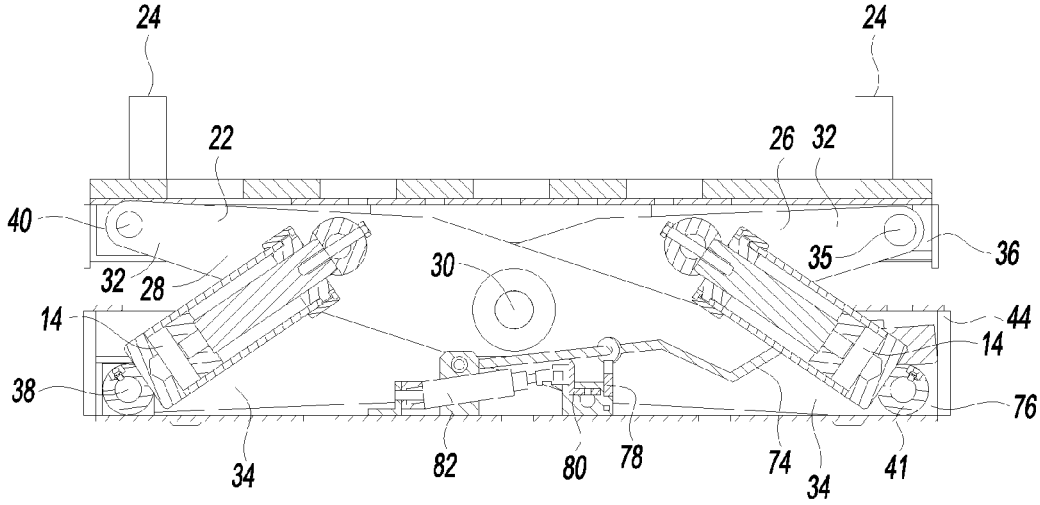
FIG. 6B illustrates a section view along section 6-6 in FIG. 3 showing an embodiment of the mobile jack of the present invention in a lowered and unlocked position.

FIG. 6A and FIG. 6B illustrate a section view along section 6-6 showing a front section view which further illustrates the locking assembly 70 when the mobile jack 10 is raised and lowered. FIG. 6A shows the mobile jack 10 in a raised position such that the scissor legs 26, 28 and hydraulic cylinders 14 are extended so that the upper platform 22 is in a raised position and the lock assembly 70 is in a locked position. FIG. 6B in a position where the scissor assembly has not raised enough to engage the lock assembly 70, so that the lock assembly is still in an unlocked position. As illustrated in FIG. 6B, when the lock assembly 70 is unlocked, the mobile jack 10 may be in a lowered position such that the scissor legs 26, 28 are collapsed and hydraulic cylinders 14 are retracted so that the upper platform 22 is also in a lowered position.

The lock assembly 70 may have a locking arm 74 which is located at a mid-portion of the base 20. The locking arm 74 may be pivotally mounted on the movable base 20 at its first end and have a locking element 76 at the second end. In the locked position the locking element 76 may be rotated and lowered so that it is adjacent or in contact with the base 20 and disposed between the lower end 34 of the second leg and the and stop wall 44 of the base 20.

The locking arm 74 may be further connected to the base 20 by a spring 78. The spring 78 may bias the locking assembly 70 so that the locking arm 74 and locking element 76 may be lowered into the locked position automatically. When the lock assembly 70 is in a locked position, as illustrated in FIG. 6A, the pneumatic cylinder 82 may be retracted.

The locking arm 74 may also be connected to a release mechanism 72. The locking assembly 70 may be a pneumatic controlled safety lock to ensure the safety of the mobile jack 10 when the hydraulic cylinders 14 are extended so that the scissor assemblies 12 and upper platform 22 can not be inadvertently lowered. The release mechanism 72 may include an actuator, such as a pneumatic cylinder 82, which may be remotely activated on the control panel 50. By activating the release mechanism 72, the pneumatic cylinder would extend and a cam 80 operatively connected or attached to the pneumatic cylinder 82 would engage the locking arm 74 in order to rotate the locking arm 74 into an unlocked position.

FIG. 6B illustrates the mobile jack 10 in a position where the scissor assembly has not raised enough to engage the lock assembly 70, so that the lock assembly is still in an unlocked position. In the unlocked position, the locking arm 74 may be pivotally raised so that the locking arm 74 may not contact the base 20. Until the scissor assembly raises enough so that the lower end 34 of the second scissor leg 28 moves inboard to a position where the locking element 76 may be lowered against the base 20, the locking arm 74 may rest on the lower end 34 of the second scissor leg 28 or the roller 41 connecting the pair of scissor assemblies 12. In the unlocked position, the spring 78 may be extended so that there is a spring bias on the locking arm 74 in the downward direction. The release mechanism 72 may not be actuated while the lock assembly 70 is in the unlocked position so that the locking element 76 may be lowered by the spring 78 when the scissor assembly is raised high enough raised position.

Figure 7A:
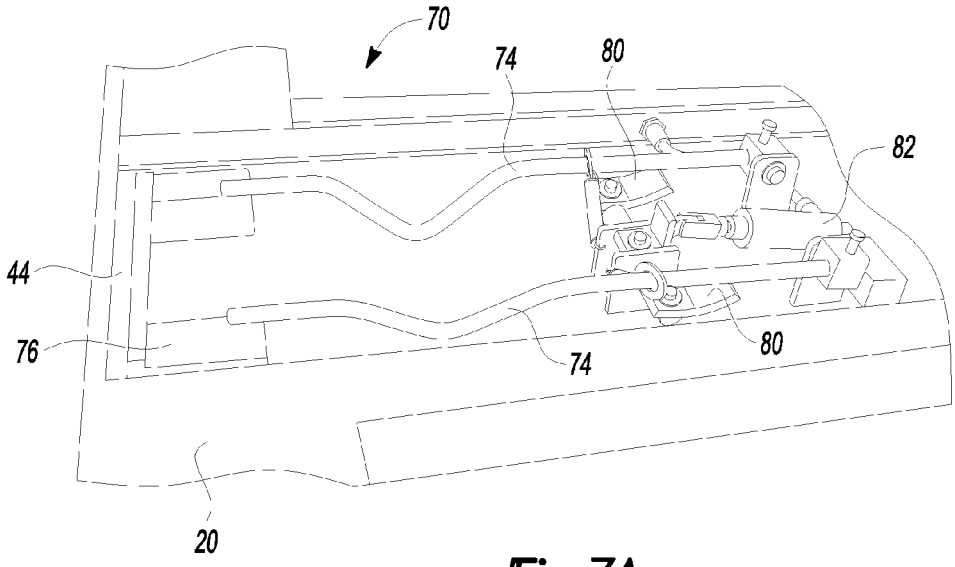
FIG. 7A illustrates a detailed view of the locking assembly in a locked position.
Figure 7B:
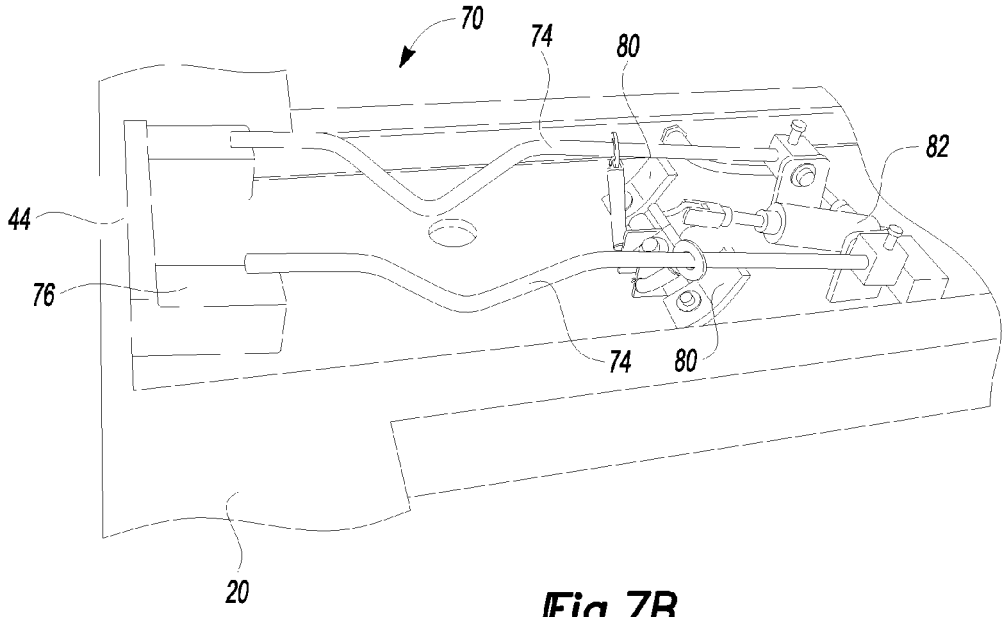
FIG. 7B illustrates a detailed view of the locking assembly in an unlocked position.

FIG. 7A and FIG. 7B are a detailed view of the release mechanism 72 and locking assembly 70 of an exemplary embodiment of the present invention. FIG. 7A shows the locking assembly 70 in a locked position so that the locking element 76 is in contact with the base 20. FIG. 7B illustrates the locking assembly 70 in an unlocked position where the release mechanism 72 is engaged.

When the locking assembly 70 is in the locked position such that the locking element 76 may be in contact with the base 20 or located between the lower end 34 of the second scissor legs 28 and the stop wall 44, thereby prevents the lower end 34 of the second scissor legs 28 from sliding outboard as well as preventing the mobile jack 10 from being lowered.

While one exemplary embodiment of the locking assembly 70 is illustrated, it is also contemplated that another locking assembly 70 may be used to prevent the mobile jack 10 from lowering. The locking assembly 70 may move to connect at least two of the components of the mobile jack 10 of the first and second scissor assemblies 12 or the upper platform 22 or base 20. For example, the locking assembly 70 may position a locking element 76 between the first scissor leg 26 and second scissor leg 28 which prevents the scissor assembly from lowering. Alternatively, a locking element 76 may be configured to extend between the first scissor leg 26 or the second scissor leg 28 and the upper platform 22 in order to lock the mobile jack 10 in a raised position. Conversely, the locking element a locking assembly 70 may connect the base 20 and one of the first 26 or second scissor legs 28, as illustrated in FIG. 6, for example.

Locking element 76 geometry may be any configuration to prevent the scissor assemblies 12 from lowering. As illustrated in FIGS. 7A and 7B, the locking element may be formed as a single piece with two blocks connected by a solid bar. Each of the blocks may fit between the lower end 34 of the second scissor legs 28 when the pair of scissor assemblies 12 are raised. As a one-piece locking element 76, the locking arms 74 may act in unison. However, the locking element 76 may be formed of several individual locking elements of blocks 76. As such, the locking elements 76 may be different sized so that each the locking element 76 drops to a locked position as the scissor assemblies 12 are actuated to various heights. In this case, the locking arms 74 may rotate independently. In any case, the release mechanism 72 may unlock the locking arms 74 and locking elements 76 in unison.

In any locking configuration, the lock assembly 70 may be spring biased such that when the upper platform 22 is moved to the lifted position the spring force causes the lock to be moved into a lock position. It is further contemplated that the lock assembly 70 may have more than one locking arms 74, and more than one locking element 76 for locking the mobile jack 10 in additional locking positions.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Further, the features of various implementing embodiments may be combined to form further embodiments of the invention.

What is claimed is:

1. A mobile jack for a vehicle, the jack comprising:

a movable base including a plurality of rollers adapted for moving and positioning the jack upon a generally horizontal support surface;

an upper platform adapted for lifting loads, the upper platform movable between at least one lowered position and at least one lifted position;

a pair of scissor lifting assemblies each lying in a vertical plane located adjacent to and spaced apart from one another, the scissor assemblies adapted for lifting the upper platform, each of the scissor assemblies having a first scissor leg having an upper and lower ends, the lower ends of the first legs pivotally fixed to the movable base and the upper ends of the first legs translating along the upper platform, and each of the scissor assemblies having a second scissor leg pivotally fixed to the first scissor leg at a horizontal scissor axis, the second legs having an upper and lower ends, the lower ends of the second scissor legs translating along the movable base, the upper end pivotally mounted to the upper platform;

a pair of hydraulic cylinders adapted for lifting the upper platform between the lowered and lifted positions, a first one of the hydraulic cylinders operatively connected between the upper end of the first scissor legs and the lower end of the second scissor legs, the other of the hydraulic cylinders operatively connected between the upper end of the second scissor legs and the lower end of the first scissor legs; and a lock assembly adapted for locking the upper platform in at least one lifted position independent of the actuation of the hydraulic cylinders, the lock assembly having a locking arm pivotally mounted on the movable base at a first end and the locking arm having a locking element at a second end, wherein when the upper platform is in at least one of the lifted positions, the lower ends of the second scissor legs slide inboard with respect to the first scissor legs, and the locking arm thereby pivots so that the locking element is lowered and supported by the base outboard of the lower ends of the second scissor legs, thereby preventing the second scissor legs from sliding back to the lowered position.

2. The mobile jack of claim 1 wherein the locking arm is spring-biased such that when the upper platform is in the lowered position, the lock arm is biased against the lower end of the second scissor legs, and when the upper platform is moved to the lifted position, the lower end of the second scissor legs slide inboard so the locking element is no longer supported, the spring-force thereby causing the locking element to be lowered against the movable base.

3. The mobile jack of claim 1 further comprising a release mechanism to release the locking assembly, the release mechanism including a cam assembly and cylinder actuator, the cam assembly operatively connecting the locking assembly and cylinder actuator, such that when the cylinder is actuated, the cam engages the locking arm causing the locking arm to pivot and raise the locking element, thereby allowing the upper platform to move to a lowered position.

4. The mobile jack of claim 1 wherein the jack further includes a handle for positioning the jack under loads, wherein the handle is operatively connected to the movable base and extends transversely from the scissor assemblies and includes a control panel for controlling the hydraulic cylinder and the release mechanism remote from the movable base.

5. A mobile jack comprising:

a movable base including a plurality of rollers adapted for moving and positioning the jack upon a generally horizontal support surface;

an upper platform adapted for lifting loads;

at least one scissor lifting assembly having a first scissor leg having an upper and lower end, the lower end pivotally fixed to the movable base, the upper end translating along the upper platform, and a second scissor leg pivotally coupled to the first scissor leg at a scissor pivot point, the second leg having an upper and lower ends, the lower end translating along the movable base, the upper end pivotally fixed to the upper platform;

at least two hydraulic cylinders operatively connected to the scissor lifting assembly and adapted for actuating the first and second scissor legs thereby moving the upper platform between a lowered position and a lifted position, one of the hydraulic cylinders operatively connected to the first scissor leg and the other of the hydraulic cylinders operatively connected to the second scissor leg; and a lock adapted for locking the at least one scissor lifting assemblies in the lifted position, the lock movable between at least one locked position and at least one unlocked position, wherein when the upper platform is in the lifted position, the lock is in the unlocked position and engages at least one of the scissor legs and the base or the other scissor leg to limit movement thereby preventing the at least one scissor assembly from lowering independent of the cylinders.

6. The mobile jack of claim 5 wherein when the lock is in the locked position, the lock is disposed between a stop member and the scissor lifting assembly thereby preventing the scissor assembly from lowering.

7. The mobile jack of claim 5 wherein the lock is spring-biased such that when the upper platform is moved to the lifted position the spring-force thereby causes the lock to be moved into the locked position.

8. The mobile jack of claim 5 wherein when the lock is in the unlocked position, the lock is supported by the second scissor leg.

9. The mobile jack of claim 5 wherein in the lowered position, the first and second scissor leg are generally parallel with the movable base.

10. The mobile jack of claim 5 wherein in the lowered position, the hydraulic cylinders are generally parallel with the moveable base.

11. The mobile jack of claim 5 further comprising a release mechanism to release the lock.

12. The mobile jack of claim 11 wherein the release mechanism includes an actuator such that when the actuator is actuated the actuator operatively moves the lock into the unlocked position so that the lock disengages the at least one scissor lifting assembly the thereby allowing the upper platform to be moved to the lowered position.

13. The mobile jack of claim 5 wherein the jack further includes a handle for positioning the jack under loads, wherein the handle is operatively connected to the moveable base and extends transversely from the at least one scissor lifting assembly and includes a control panel for controlling the hydraulic cylinders and a release mechanism remotely and away from the movable base.

14. The mobile jack of claim 6 wherein the stop member is disposed on a top surface of the base and in the lowered position, the lower end of the second leg abuts the stop member, the lower end sliding transverse to the stop when moved to the lifted position wherein the lock is disposed between the stop member and the second scissor leg in the lifted position.

15. A mobile jack comprising:

a movable base including a plurality of rollers adapted for moving the jack upon a generally horizontal support surface and positioning the jack under a load;

an upper platform adapted for lifting loads;

a scissor assembly lying in a vertical plane, the scissor assembly connected between the movable base and the upper platform, the scissor assembly adapted for lifting the upper platform between at least one lowered position and at least one lifted position;

at least one hydraulic cylinder operatively connected to and adapted for actuating the scissor assembly; and a safety lock adapted for locking the upper platform in at least one lifted position, the lock movable between at least one locked and unlocked position, wherein when the upper platform is in the lifted position, the lock automatically moves to the locked position so that it cooperates with the scissor assembly to prevent the scissor assembly from lowering independent of the cylinders.

16. The mobile jack of claim 15 wherein when the lock is in the locked position, the lock is disposed between a stop member and the scissor assembly thereby preventing the scissor assembly from lowering.

17. The mobile jack of claim 15 wherein the lock is spring-biased such that when the upper platform is moved to the lifted position the spring-force thereby causes the lock to be moved into the locked position.

18. The mobile jack of claim 15 further comprising a release mechanism to release the locking assembly.

19. The mobile jack of claim 18 wherein the release mechanism includes a cylinder cylinder such that when the cylinder is actuated the cylinder operatively moves the lock into the unlocked position thereby allowing the scissor lifting assembly to be lowered to the lowered position.

20. The mobile jack of claim 15 wherein the jack further includes a handle for positioning the jack under loads, wherein the handle is operatively connected to the moveable base and extends transversely from the scissor assemblies, the handle including a control panel for controlling the hydraulic cylinder and release mechanism remote from the movable base.

* * * * *

UNITED STATES PATENT AND TRADEMARK OFFICE

CERTIFICATE OF CORRECTION

PATENT NO. : 8,308,134 B2
APPLICATION NO. : 12/763636
DATED : April 20, 2010
INVENTOR(S) : Branimir Stanimirovic et al.

It is certified that error appears in the above-identified patent and that said Letters Patent is hereby corrected as shown below:

Column 12, Line 20, Claim 19:

After "release mechanism in a"
Delete "cylinder" (second occurrence)

Signed and Sealed this
Twelfth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,308,134 B2
APPLICATION NO. : 12/763636
DATED : November 13, 2012
INVENTOR(S) : Branimir Stanimirovic et al.

It is certified that error appears in the above-identified patent and that said Letters Patent is hereby corrected as shown below:

In the specification

Column 2, Line 46:

After "platform is in the lifted position, the lock is in the"
Delete "unlocked" Add "locked"

In the claims

Column 10, Line 46, Claim 5:

After "the lock is in the"
Delete "unlocked" Add "locked"

Signed and Sealed this
Thirty-first Day of May, 2016

Michelle K. Lee

Michelle K. Lee
*Director of the United States Patent and Trademark Office*